United States Patent [19]

Walkup

[11] 4,392,702

[45] Jul. 12, 1983

[54] SHORTING JUMPER

[75] Inventor: William B. Walkup, Southboro, Mass.

[73] Assignee: Ark-les Corporation, Watertown, Mass.

[21] Appl. No.: 250,435

[22] Filed: Apr. 2, 1981

[51] Int. Cl.[3] ..... H01R 31/08

[52] U.S. Cl. ..... 339/19

[58] Field of Search ..... 339/19, 222, 18 R, 18 C, 339/18 P

[56] References Cited

U.S. PATENT DOCUMENTS 3,918,788 11/1975 Walter et al. ..... 339/19

OTHER PUBLICATIONS

Malco Manufacturing Co., Wrapost Jumper Clips, 1964.

Oriental Terminal Products Co., Ltd. Publication, Japan, 1/80.

*Primary Examiner*—Neil Abrams

[57] ABSTRACT

A jumper adapted to electrically connect adjacent ones of an array of uninsulated conductive substantially rigid vertical pins. The jumper is formed of resilient, electrically conductive sheet material and comprises a generally vertical plate portion having a free upper lengthwise edge and two generally vertical side edges, and a pin-retaining spring portion integrally connected lengthwise to the plate portion. The jumper further provides position stabilizing means comprising two arms, each arm being integrally connected to a side edge of the plate portion and bent away from the plate portion at an angle of about ninety degrees thereto. The arms are lengthwise spaced apart by a spacing adapted to clear the outer surfaces of the two adjacent pins to be connected, whereby the arms stabilize the jumper to resist tilting thereof and to prevent shorting other adjacent conductive pins.

2 Claims, 6 Drawing Figures

FIG 1
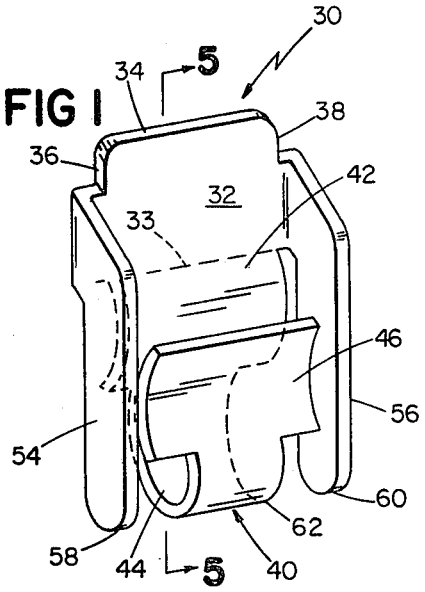
FIG 6
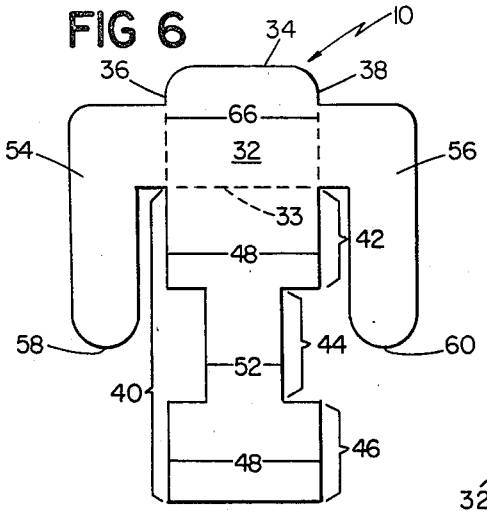
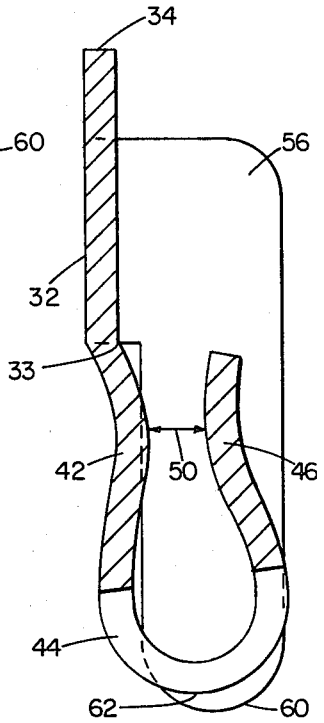
FIG 5
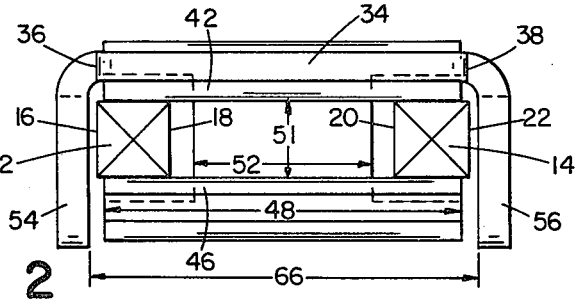
FIG 2
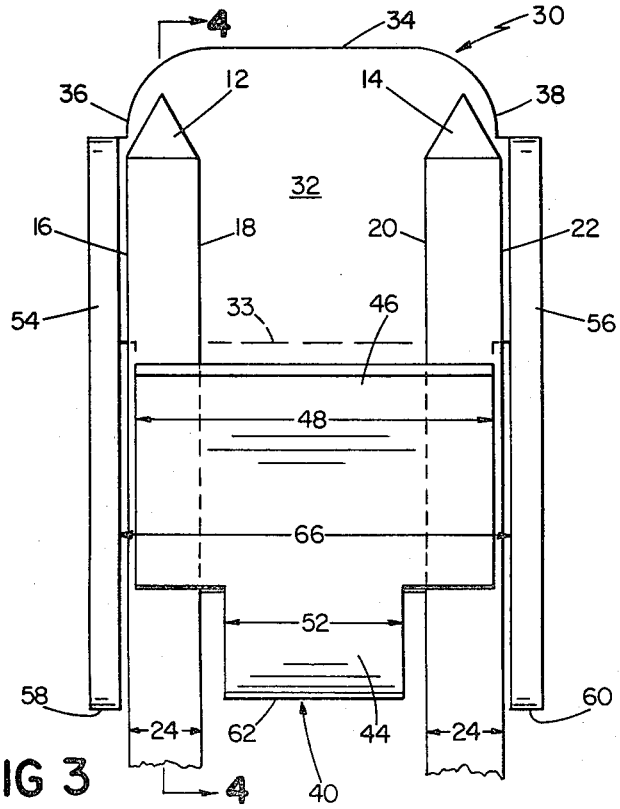
FIG 3
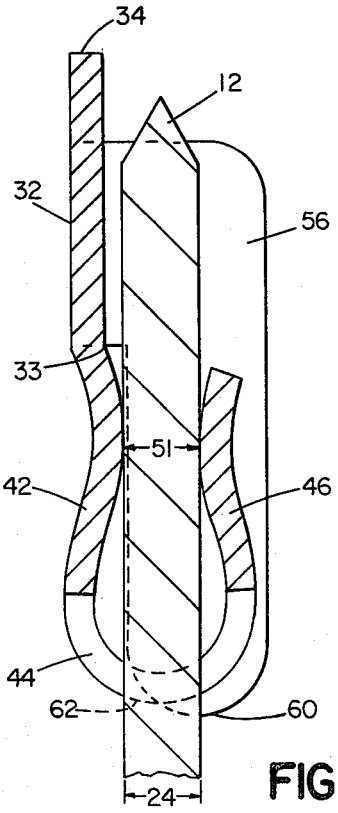
FIG 4

SHORTING JUMPER

This invention relates to electrical connectors, and more particularly to an electrical connector for connecting two adjacent electrically conductive pins in an array of such pins.

The use of electrical connectors to connect an array of electrically conductive pins, and in particular, to connect two adjacent pins in such an array is well known in the prior art. However, the electrical connectors in the prior art are usually deficient in several aspects. One disadvantage is that they are bulky and composed of many parts. Another disadvantage is that the connector used to interconnect two pins tends to tilt, causing the undesired effect of shorting other adjacent pins.

Accordingly, it is a major object of the present invention to provide a novel electrical connector which resists tilting to prevent shorting of adjacent electrical conducting pins.

It is another major object of the present invention to provide a novel one-piece electrical connector.

The above and still further objects of the present invention are achieved by providing a jumper formed of resilient, electrically conductive sheet material. According to the invention, the jumper comprises a generally vertical plate portion having a free upper lengthwise edge and two generally vertical side edges, and a pin-retaining spring portion integrally connected lengthwise to the plate portion.

The pin-retaining spring portion includes two cooperating pin-gripping portions, each of which has a length adapted to span at least the greater part of two adjacent pins to be connected, and a neck portion which has a length adapted to pass between the two adjacent pins to be connected. A first one of the pin-gripping portions is integrally connected lengthwise with the plate portion remote from its free upper edge, and a second one of the pin-gripping portions is spaced widthwise from the first pin-gripping portion, the pin-gripping portions being generally opposed to one another and convexly curved toward one another. The opposed convexly curved pin-gripping portions define the closest spacing therebetween.

The neck portion is integrally connected lengthwise to each of the pin-gripping portions and forms a generally U-shaped curve which is convexly and downwardly curved away from the pin-gripping portions. The neck portion is adapted to space the pin-gripping portions apart widthwise by an unstressed closest spacing which is less than the thickness of a pin to be connected. The U-shaped curved neck portion, together with the convexly curved pin-gripping portions, define the pin-retaining spring portion as reentrantly curved, and bias the pin-gripping portions widthwise inwardly toward one another for positive gripping therebetween of the two adjacent pins to be connected.

The jumper further provides position stabilizing means, which comprises two arms, each of the arms being integrally connected to a side edge of the plate portion and bent toward the second pin-gripping portion at an angle of about ninety degrees to the plate portion. The arms are lengthwise spaced apart by a spacing adapted to clear the outer surfaces of the two adjacent pins to be connected. The arms extend downwardly to at least about the lowest point of the neck portion U-shaped curve. The arms extend widthwise from at least about the inner surface of the first pin-gripping portion to at least the junction of the second pin-gripping portion and the neck portion, whereby the arms stabilize the jumper to resist tilting thereof and to prevent shorting other adjacent conductive pins.

Other objects, features, and advantages of the present invention will appear from the following detailed description of a preferred embodiment thereof, taken together with the accompanying drawings, wherein:

FIG. 1 is a perspective view of the jumper of the present invention;

FIG. 2 is a plan view of the jumper of FIG. 1, as mounted on two pins;

FIG. 3 is a front view of the jumper of FIG. 2, partially broken away;

FIG. 4 is a side cross section view of the jumper of FIG. 3, taken along line 4—4;

FIG. 5 is a side cross section view of the jumper of FIG. 1, taken along line 5—5; and FIG. 6 is a blank of the jumper of the present invention.

Referring to the drawings, the jumper of the present invention, generally designated 30, is shown in FIGS. 1 and 5 before its installation on two adjacent electrically conductive pins 12 and 14, in FIGS. 2 through 4 as mounted across two adjacent pins 12 and 14, and in FIG. 6 as a blank.

More specifically, electrically conductive pins, such as pins 12 and 14, are generally uninsulated, substantially rigid, and vertical. They are usually positioned as an array of pins on terminal boards, not shown. Each pair of such pins 12 and 14 define their respective inner surfaces 18 and 20 and outer surfaces 16 and 22, as best shown in FIG. 2. Each pin is generally rectangular, obelisk-like, having a thickness or diameter 24. A small gauge, electrically conductive wire, also not shown, is usually wound around each pin to have the sharp corners of a generally rectangular pin embed in the wire, not shown, thereby achieving a sound electrical connection. This method of connection gives rise to the name of wire-wrap terminal pin.

Referring first to FIG. 6, blank 10 for jumper 30 includes a back plate portion 32 and a pin-retaining spring portion 40. Back plate portion 32 has a free upper lengthwise edge 34 and two generally vertical side edges 36 and 38 which are connected to upper edge 34.

Pin-retaining spring portion 40, which is integrally connected lengthwise to lower edge 33 of plate portion 32, comprises two pin-gripping portions 42 and 46 and a neck portion 44 between them. Each of pin-gripping portions 42, 44 has a length 48 which is adapted to span at least the greater part of two adjacent pins 12 and 14 to be connected, from about outer surface 16 of pin 12 to about outer surface 22 of pin 14. First pin-gripping portion 42 is integrally connected lengthwise to lower edge 33 of plate portion 32.

Neck portion 44 has a length 52 which is adapted to pass between two adjacent pins 12 and 14 to be connected, clearing inner surface 18 of pin 12 and inner surface 20 of pin 14. Neck portion 44 is integrally connected lengthwise to each of the pin-gripping portions 42 and 46.

Blank 10 further provides two arms 54 and 56, each of arms 54 and 56 being integrally connected to a side edge 36, or 38 of plate portion 32, respectively. Arms 54 and 56 are lengthwise spaced apart by a spacing 66 which is adapted to clear the outer surfaces 16 and 22 of the two adjacent pins 12 and 14 to be connected.

Using blank 10 shown in FIG. 6, a conventional progressive die may be used to first bend pin-retaining spring portion 40 into a reentrantly curved configuration with opposed convexly curved pin-gripping portions 42 and 46 and generally U-shaped curve neck portion 44, as shown in FIGS. 1 and 5. Arms 54 and 56 are then bent away from back plate portion 32 toward second pin-gripping portion 46 at an angle of about ninety degrees.

The novel jumper 30 of the present invention may be mounted across any two adjacent wire-wrap terminal pins to form a common electrical connection therebetween. As may be seen in FIG. 1, jumper 30 includes a generally vertical back plate portion 32 and a pin-retaining spring portion 40. Back plate portion 32 has a free upper lengthwise edge 34 and two generally vertical side edges 36 and 38 which are connected to upper edge 34.

Pin-retaining spring portion 40, which is integrally connected lengthwise to lower edge 33 of plate portion 32, comprises two cooperating pin-gripping portions 42 and 46 and a neck portion 44 between them. Each of pin-gripping portions 42, 44 has a length 48 which is adapted to span at least the greater part of two adjacent pins 12 and 14 to be connected, from about outer surface 16 of pin 12 to about outer surface 22 of pin 14. First pin-gripping portion 42 is integrally connected lengthwise to lower edge 33 of plate portion 32 and second pin-gripping portion 46 is spaced widthwise from pin-gripping portion 42, pin-gripping portions 42 and 46 being generally opposed to one another and convexly curved toward one another. The opposed convexly curved pin-gripping portions 42 and 46 define an unstressed closest spacing 50 therebetween, as best shown in FIG. 5.

Neck portion 44 has a length 52 which is adapted to pass between two adjacent pins 12 and 14 to be connected, clearing inner surface 18 of pin 12 and inner surface 20 of pin 14. Neck portion 44 is integrally connected lengthwise to each of the pin-gripping portions 42 and 46 to form a generally U-shaped curve which is convexly and downwardly curved away from pin-gripping portions 42 and 46, as best shown in FIG. 5. Neck portion 44 spaces apart pin-gripping portions 42 and 46 widthwise by the unstressed closest spacing 50 less than the diameter 24 of a pin to be connected. The U-shaped curved neck portion 44 and convexly curved pin-gripping portions 42 and 46 together define pin-retaining spring portion 40 as reentrantly curved and bias pin-gripping portions 42 and 46 widthwise inwardly toward one another for positive gripping therebetween of two adjacent pins 12 and 14 to be connected. Thus mounted, the opposed convexly curved pin-gripping portions 42 and 46 now define a stressed closest spacing 51, as best shown in FIG. 4.

Jumper 30 further provides position stabilizing means which comprises two arms 54 and 56, each of arms 54 and 56 being integrally connected to side edge 36, 38 of plate portion 32, respectively, and bending toward second pin-gripping portion 46 at an angle of about ninety degrees to plate portion 32. Arms 54 and 56 are lengthwise spaced apart by a spacing 66 which is adapted to clear the outer surface 16 and 22 of the two adjacent pins 12 and 14 to be connected. Each of arms 54 and 56 has a lower edge 58, 60 which extends downwardly to the mid point 62 of neck portion U-shaped curve 44, as best shown in FIG. 5. Arms 54 and 56 extend widthwise from the inner surface 64 of first pin-gripping portion 42 to junction 68 of second pin-gripping portion 46 and neck portion 44, also best shown in FIG. 5, Arms 54 and 56, thereby, stabilize jumper 30 to resist lengthwise tilting thereof and to prevent shorting other adjacent conductive pins.

In the preferred embodiment, jumper 30 is manufactured from a resilient, electrically conductive sheet of phosphor bronze approximately 0.01 inches in thickness. Jumper 30 has a height of approximately 0.22 inches from back plate portion upper edge 34 to lower edge 58, 60 of either arm 54 or 56; a spacing 66 of approximately 0.13 inches between arms 54 and 56; a pin-gripping portion length 48 of approximately 0.12 inches and neck portion length 52 of approximately 0.06 inches; and an unstressed closest spacing 50 of approximately 0.02 inches.

In use, as best shown in FIGS. 2 through 5, jumper 30 is mounted across two adjacent pins 12 and 14. Arms 54 and 56, spaced apart by spacing 66, clear outer surfaces 16 and 22 of pins 12 and 14, respectively. Similarly, neck portion 44 of pin-retaining spring portion 40, having a length 52, clears inner surfaces 18 and 20 of pins 12 and 14, respectively. The opposed convexly curved pin-gripping portions 42 and 46 of pin-retaining spring portion 40 are forced apart to the stressed closest spacing 51, as best shown in FIG. 4, and cooperate to positively grip pins 12 and 14 for sound electrical connection therebetween. Arms 54 and 56 stabilize jumper 30 by resisting lengthwise tilting thereof, thereby preventing shorting with other adjacent electrically conductive pins.

In an alternative embodiment of the present invention, not shown, a suitable plastic insulating material is molded as a separate entity and the jumper is inserted and secured therein. The insulator covers the outer surfaces of jumper 30, from about the back plate portion, along both outer edges and surfaces of arm 54 and 56. The insulator increases ease of handling jumper 30 and the ease of aligning jumper 30 on pins 12, 14, and prevents over stressing of the pin retaining spring portion 40 when jumper 30 is handled by the user.

What is claimed is:

1. A jumper adapted to electrically connect adjacent ones of an array of uninsulated conductive substantially rigid vertical pins, said jumper being formed of resilient, electrically conductive sheet material and comprising a generally vertical plate portion having a free upper lengthwise edge and two generally vertical side edges, a pin-retaining spring portion integrally connected lengthwise to said plate portion and comprising two cooperating pin-gripping portions each having a length adapted to span at least the greater part of two adjacent pins to be connected, a first said pin-gripping portion being integrally connected lengthwise with said plate portion remote from its said free upper edge, the second said pin-gripping portion being spaced widthwise from said first pin-gripping portion, a neck portion having a length adapted to pass between two adjacent pins to be connected, said neck portion being integrally connected lengthwise to each said pin-gripping portion, said jumper further providing position stabilizing means comprising two arms, each said arm being integrally connected to a said side edge of said plate portion and bent toward said second pin-gripping portion at an angle of about ninety degrees to said plate portion, said arms being lengthwise spaced apart by a spacing adapted to clear the outer surfaces of two adjacent pins to be connected, said arms extending widthwise from at least about the inner surface of said first pin-gripping portion to at least the junction of said second pin-gripping portion and said neck portion, whereby said arms stabilize said jumper to resist tilting thereof and to prevent shorting other adjacent conductive pins.

2. A jumper adapted to electrically connect adjacent ones of an array of uninsulated conductive substantially rigid vertical pins, said jumper being formed of resilient, electrically conductive sheet material and comprising a generally vertical plate portion having a free upper lengthwise edge and two generally vertical side edges, a pin-retaining spring portion integrally connected lengthwise to said plate portion and comprising two cooperating pin-gripping portions each having a length adapted to span at least the greater part of two adjacent pins to be connected, a first said pin-gripping portion being integrally connected lengthwise with said plate portion remote from its said free upper edge, the second said pin-gripping portion being spaced widthwise from said first pin-gripping portion, said pin-gripping portions being generally opposed to one another and convexly curved toward one another, said opposed convexly curved pin-gripping portions defining a closest spacing therebetween, a neck portion having a length adapted to pass between two adjacent pins to be connected, said neck portion being integrally connected lengthwise to each said pin-gripping portion, and forming a generally U-shaped curve convexly and downwardly curved away from said pin-gripping apart widthwise by an unstressed said closest spacing less than the thickness of a pin to be connected, said U-shaped curved neck portion and said convexly curved pin-gripping portions together defining said pin-retaining spring portion as reentrantly curved and biasing said pin-gripping portions widthwise inwardly toward one another for positive gripping therebetween of two adjacent pins to be connected, said jumper further provided position stabilizing means comprising two arms, each said arm being integrally connected to a said side edge of said plate portion and bent toward said second pin-gripping portion at an angle of about ninety degrees to said plate portion, said arms being lengthwise spaced apart by a spacing adapted to clear the outer surfaces of two adjacent pins to be connected, said arms extending downwardly to at least about the lowest point of said neck portion U-shaped curve, said arms extending widthwise from at least about the inner surface of said first pin-gripping portion to at least the junction of said second pin-gripping portion and said neck portion, whereby said arms stabilize said jumper to resist tilting thereof and to prevent shorting other adjacent conductive pins.

* * * * *